US009116455B2

(12) United States Patent
Fukuda et al.

(10) Patent No.: US 9,116,455 B2
(45) Date of Patent: Aug. 25, 2015

(54) CHARGING DEVICE

(71) Applicant: CANON KABUSHIKI KAISHA, Tokyo (JP)

(72) Inventors: Tadashi Fukuda, Matsudo (JP); Masami Hano, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/055,600

(22) Filed: Oct. 16, 2013

(65) Prior Publication Data

US 2014/0044448 A1 Feb. 13, 2014

Related U.S. Application Data

(63) Continuation of application No. PCT/JP2013/061731, filed on Apr. 22, 2013.

(30) Foreign Application Priority Data

Apr. 27, 2012 (JP) ..... 2012-102486

(51) Int. Cl.
*G03G 15/02* (2006.01)

(52) U.S. Cl.
CPC ..... *G03G 15/0258* (2013.01); *G03G 15/0291* (2013.01); *G03G 15/0225* (2013.01)

(58) Field of Classification Search
CPC ..... G03G 15/0291; G03G 2215/027; G03G 15/0225; G03G 15/0258
USPC ..... 399/170, 171, 100
See application file for complete search history.

(56) References Cited

U.S. PATENT DOCUMENTS

| | | | | |
|---|---|---|---|---|
| 2008/0226334 | A1 | 9/2008 | Ohno et al. | |
| 2009/0136261 | A1 * | 5/2009 | Hayashi et al. | 399/171 |
| 2009/0269105 | A1 | 10/2009 | Hano | |
| 2010/0054793 | A1 * | 3/2010 | Parks | 399/100 |
| 2010/0158550 | A1 | 6/2010 | Makino et al. | |

FOREIGN PATENT DOCUMENTS

| | | | |
|---|---|---|---|
| JP | 6-016961 | U | 3/1994 |
| JP | 2006-091484 | A | 4/2006 |
| JP | 2008-233254 | A | 10/2008 |
| JP | 2009-163206 | A | 7/2009 |
| JP | 2009-265235 | A | 11/2009 |
| JP | 2011-209698 | A | 10/2011 |
| JP | 2012-063592 | A | 3/2012 |

* cited by examiner

*Primary Examiner* — Roy Y Yi
(74) *Attorney, Agent, or Firm* — Canon USA Inc IP Division

(57) ABSTRACT

A grid of a charging device is cleaned without causing the grid to contact a member to be charged. In this structure, to suppress non-uniform charging due to wear of the grid, which is pulled toward a discharge electrode, for a long time, first and second protective layers are provided. The first protective layer is provided on a surface of a base member of the grid that faces the cleaning member. The second protective layer is provided on a surface of the base member that faces the pressing member. The second protective layer is thicker than the first protective layer.

10 Claims, 11 Drawing Sheets

CHARGING DEVICE

CROSS-REFERENCE TO RELATED APPLICATIONS

This application is a Continuation of International Patent Application No. PCT/JP2013/061731, filed Apr. 22, 2013, which claims the benefit of Japanese Patent Application No. 2012-102486, filed Apr. 27, 2012, both of which are hereby incorporated by reference herein in their entirety.

TECHNICAL FIELD

The present invention relates to a charging device which charges a member to be charged.

BACKGROUND ART

A scorotron charger including a grid is known as a corona charger that charges a photosensitive member, which is a member to be charged. There are basically two types of grids. One type is a wire grid that includes wires arranged in an opening in a housing of a corona charger so as to extend in a longitudinal direction. The other type is an etching grid produced by forming many holes in a thin plate by an etching process.

The etching grid covers a larger area of the opening in the housing (has a smaller opening ratio) than the wire grid, and is therefore advantageous in that the potential of a photosensitive member can be easily controlled to a target potential. However, the etching grid more easily allows discharge products generated in a discharge process to adhere thereto than the wire grid.

The discharge products that have adhered to the etching grid (hereinafter referred to as grid) accelerate oxidation of the grid, and rusted parts of the grid have charging characteristics different from those of the other parts. This leads to non-uniform charging. PTL 1 discloses a structure for suppressing non-uniform charging by forming a protective layer, which mainly contains carbon atoms in an SP3 structure, on a surface of a base member of the grid and increasing corrosiveness against the discharge products. PTL 1 also discloses a structure in which the thickness of a protective layer that covers a front surface of the grid that faces a discharge electrode is greater than the thickness of a protective layer that covers a back surface of the grid since the surface of the grid that faces the discharge electrode is easily corroded by the discharge products.

PTL 2 discloses a structure including a cleaning member for removing toner and discharge products (hereinafter referred to as foreign matters) that have adhered to a grid. Specifically, a cleaning brush that serves as the cleaning member is provided to clean the grid from a discharge-electrode side of the grid while both end portions (edge portions) of the grid in a lateral direction are pressed against the cleaning brush at a side of the grid that faces a member to be charged.

As a result of studies conducted by the inventors, it has been found that non-uniform charging occurs in a relatively short time when both end portions of a grid in a lateral direction are pressed against a cleaning member at a side facing a member to be charged as in PTL 2.

This is probably because in the structure in which the grid is held at both ends thereof and pressed against the cleaning member to stabilize the amount of contact intrusion by which the cleaning member intrudes into the grid, the protective layer that covers the base member of the grid wears in local contact regions. The local wear results in the base member becoming exposed, and the base member becomes rusted from the exposed portions thereof. This is probably the cause of non-uniform charging.

CITATION LIST

Patent Literature

PTL 1 Japanese Patent Laid-Open No. 2008-233254
PTL 2 Japanese Patent Laid-Open No. 2006-091484

Accordingly, in a structure in which a grid is cleaned while being pressed against a cleaning member, an object of the present invention is to suppress non-uniform charging, which is caused by wear of the grid due to the grid being pressed against the cleaning member, for a long time.

Other objects of the present invention will become apparent from the following detailed description with reference to the accompanying drawings.

SUMMARY OF INVENTION

A charging device that charges a member to be charged according to the present application includes a discharge electrode; a housing that surrounds the discharge electrode and has an opening that faces the member to be charged; a plate-shaped grid provided at the opening; a cleaning member that cleans the grid by contacting a surface of the grid that faces the discharge electrode; a pressing member that presses the grid against the cleaning member at a surface of the grid opposite the surface that faces the discharge electrode; and a moving mechanism that moves the cleaning member and the pressing member in a longitudinal direction of the grid. The grid includes a base member, a first protective layer provided on a surface of the base member that faces the cleaning member, the first protective layer protecting the base member, and a second protective layer provided on a surface of the base member that faces the pressing member, the second protective layer protecting the base member and being thicker than the first protective layer.

Further features of the present invention will become apparent from the following description of exemplary embodiments with reference to the attached drawings.

DESCRIPTION OF EMBODIMENTS

The schematic structure of an image forming apparatus will be described, and then a charging device will be described in detail with reference to the drawings. Dimensions, materials, shapes, relative positions, etc., of components are not intended to limit the scope of the present invention unless specifically stated otherwise.

First Embodiment

First, the schematic structure of an image forming apparatus will be briefly described, and then a charging device (corona charger) according to the present embodiment will be described in detail.

Schematic Structure of Image Forming Apparatus

A section that involves an image forming operation (image forming unit) of a printer 100 will be briefly described.

1. Schematic Structure of Entire Apparatus

Figure 1A:
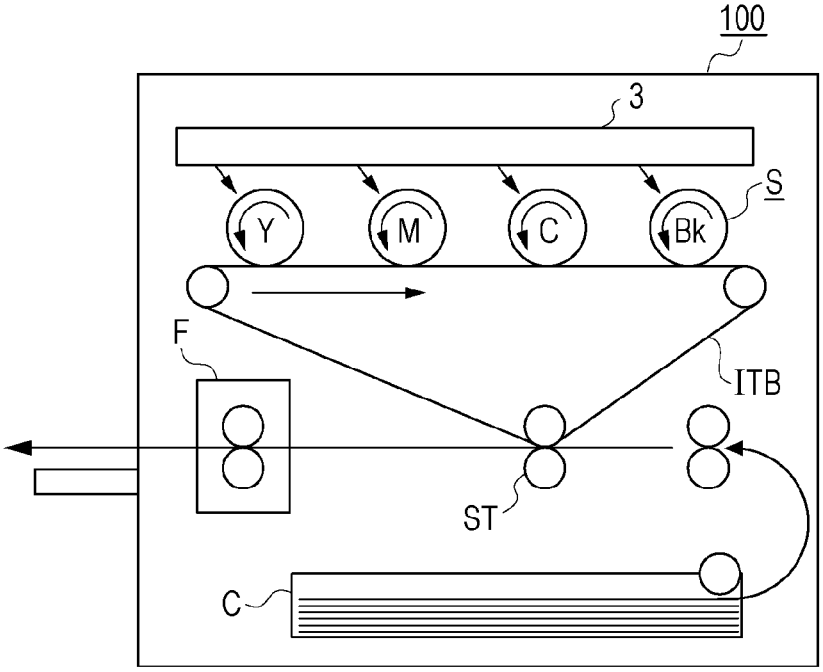
FIGS. 1A and 1B are schematic sectional views of an image forming apparatus.
Figure 1B:
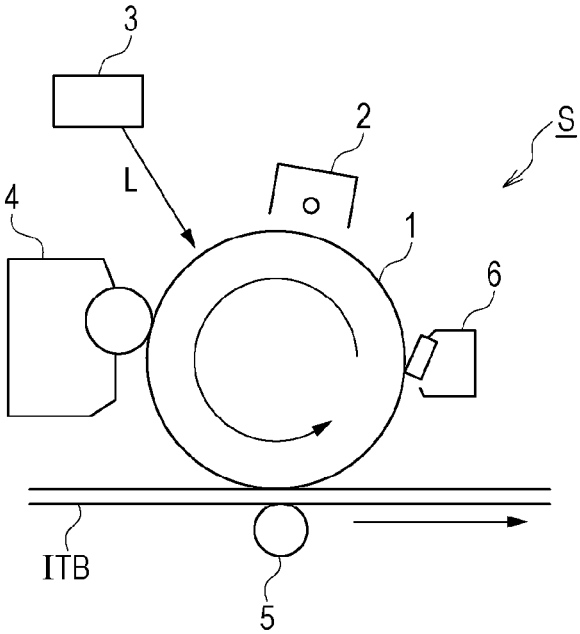

FIG. 1A is a diagram for explaining the schematic structure of the printer 100, which serves as an image forming apparatus. The printer 100 that serves as an image forming apparatus includes first to fourth stations S (Bk to Y) including respective photosensitive drums on which images are formed with different types of toners. FIG. 1B is a detailed enlarged view illustrating the structure of each station, which serves as an image forming unit. The stations are substantially identical except for the types (spectral characteristics) of the toners used to develop electrostatic images formed on the photosensitive drums. Therefore, a first station (Bk) will be described as a representative.

The station S (Bk), which serves as an image forming unit, includes a photosensitive drum 1 that serves as an image bearing member and a corona charger 2 that serves as a charging device for charging the photosensitive drum 1. The photosensitive drum 1 is charged by the corona charger 2, and then an electrostatic image is formed on the photosensitive drum by light L emitted from a laser scanner 3. The electrostatic image formed on the photosensitive drum 1 (image bearing member) is developed into a toner image with black toner contained in a developing device 4. The toner image formed on the photosensitive drum 1 is transferred onto an intermediate transfer belt ITB that serves as an intermediate transfer body by a transfer roller 5 that serves as a transfer member. Residual toner that has remained on the photosensitive drum 1 instead of being transferred onto the intermediate transfer belt is removed by a cleaning device 6 including a cleaning blade. A unit including the corona charger, the developer device, etc., which involve an operation of forming a toner image on the photosensitive drum 1 (photosensitive member), is referred to as an image forming unit. The corona charger 2 (charging device) will be described in detail below.

Thus, yellow (Y), magenta (M), cyan (C), and black (Bk) toner images are successively transferred onto the intermediate transfer belt in that order from the photosensitive drums 1 included in the respective stations, and are superimposed on top of each other. The toner images in the superimposed state are transferred onto a recording medium conveyed from a cassette C by a second transfer unit ST. Toners that have remained on the intermediate transfer belt instead of being transferred onto the recording medium by the second transfer unit ST are removed by a belt cleaner (not shown).

The toner images that have been transferred onto the recording medium are fixed to the recording medium by a fixing device F, which contacts and melts the toners to thereby thermally fix the toners to the recording medium. The recording medium to which the images have been fixed is ejected to the outside of the apparatus. The apparatus is basically structured as described above.

2. Schematic Structure of Corona Charger

Figure 2:
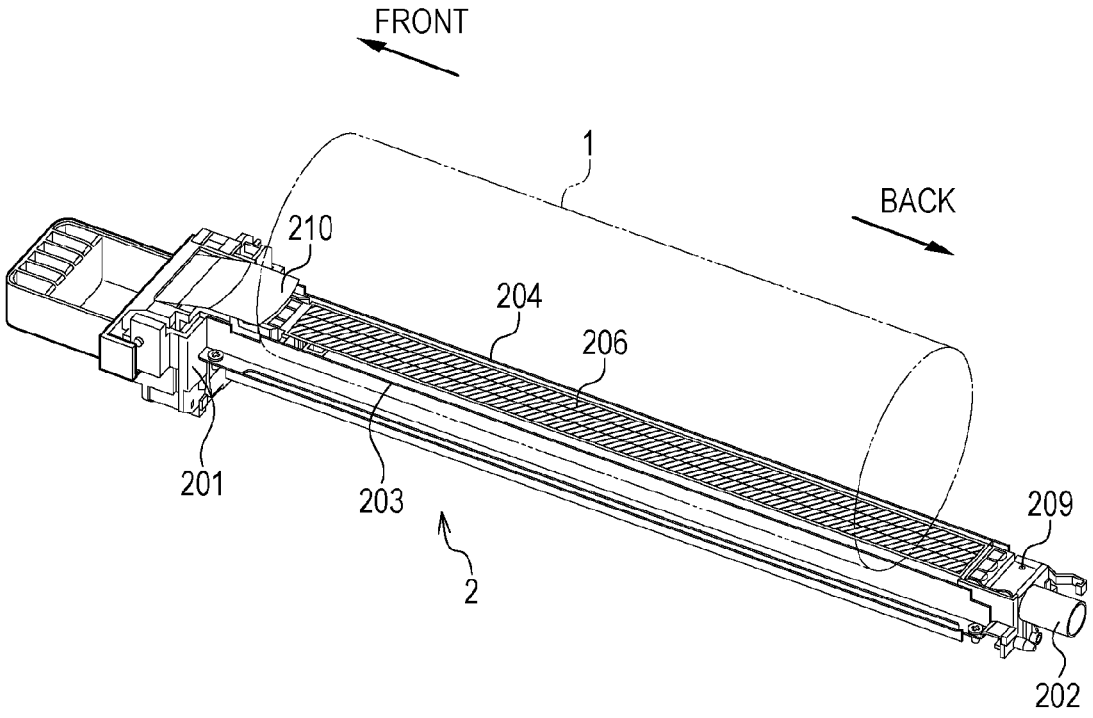
FIG. 2 is a perspective view illustrating the appearance of a corona charger according to an embodiment.
Figure 3A:
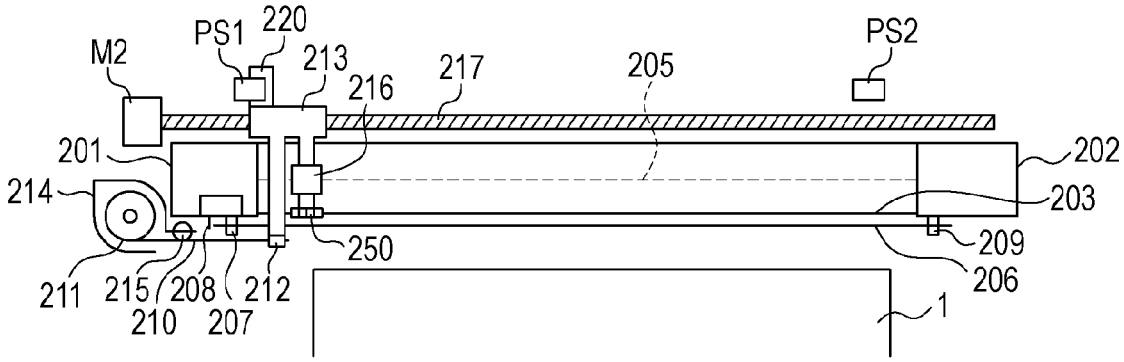
FIGS. 3A and 3B are side views of the corona charger according to the embodiment in the states in which a shutter is opened and closed.
Figure 3B:
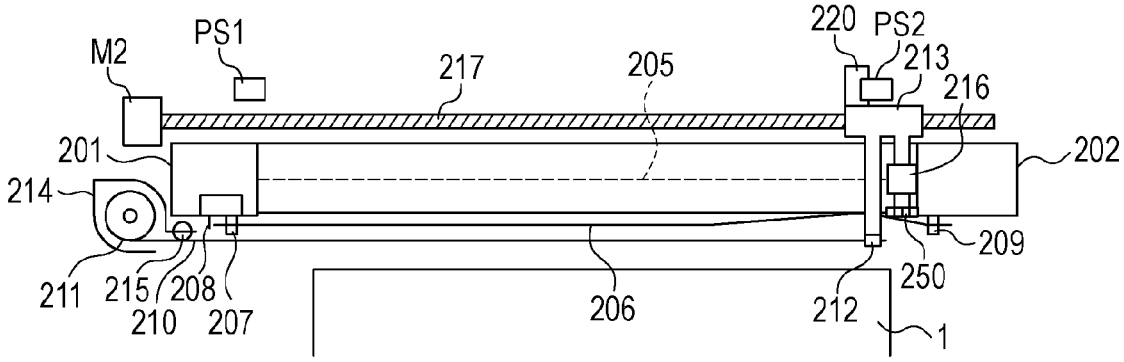

The schematic structure of the corona charger 2 will now be described. FIG. 2 is a schematic perspective view of the corona charger 2 viewed from the photosensitive member. FIGS. 3A and 3B are side views of the corona charger according to the present embodiment. The corona charger 2 includes a grid 206 and a cleaning brush 250 that serves as a cleaning member for cleaning a grid surface.

Discharge Wire

In the corona charger 2, a front block 201, a rear block 202, and shields 203 and 204 form a housing of the corona charger 2. A discharge wire 205, which serves as a discharge electrode, extends between the front block 201 and the rear block 202. When a charging bias is applied to the discharge wire 205 by a high-voltage power supply P, the discharge wire 205 discharges electricity to charge the photosensitive member 1, which serves as a member to be charged. The photosensitive member 1 faces the discharge wire 205 with the grid 206, which is disposed at an opening in the housing, provided therebetween.

The discharge wire 205, which serves as a discharge electrode, according to the present embodiment is a tungsten wire having a diameter of 50 μm. The discharge wire may be made of, for example, stainless steel, nickel, molybdenum, or tungsten. Preferably, tungsten, which is a highly stable metal, is used. The discharge wire, which extends inside the shields, may either have a circular cross section or a sawtooth shaped cross section. The structure of each component will now be described in detail.

When the diameter of the discharge wire is too small, the discharge wire will be cut or break due to impact of ions during discharge. When the diameter of the discharge wire is too large, a high voltage needs to be applied to the discharge wire 205 to generate stable corona discharge. It is not preferable to increase the applied voltage since ozone is easily generated. Accordingly, the diameter of the discharge wire is preferably in the range of 40 μm to 100 μm. The discharge wire is cleaned by a cleaning pad 216.

Etching Grid

Next, an etching grid (hereinafter referred to as a grid), which serves as a control electrode and extends in a longitudinal direction of the opening in the corona charger, will be briefly described. In the following description, even when no specific description is given, the grid is a mesh grid having a plurality of through holes that extend therethrough.

The corona charger 2 according to the present embodiment includes the plate-shaped grid 206, which serves as a control electrode, at one of the openings formed between the shields 203 and 204 of the housing, the one of the openings facing the photosensitive member. The grid 206 is disposed between the discharge wire 205 and the photosensitive member 1, and controls the amount of current that flows toward the photosensitive member when the charging bias is applied thereto.

Figure 7:
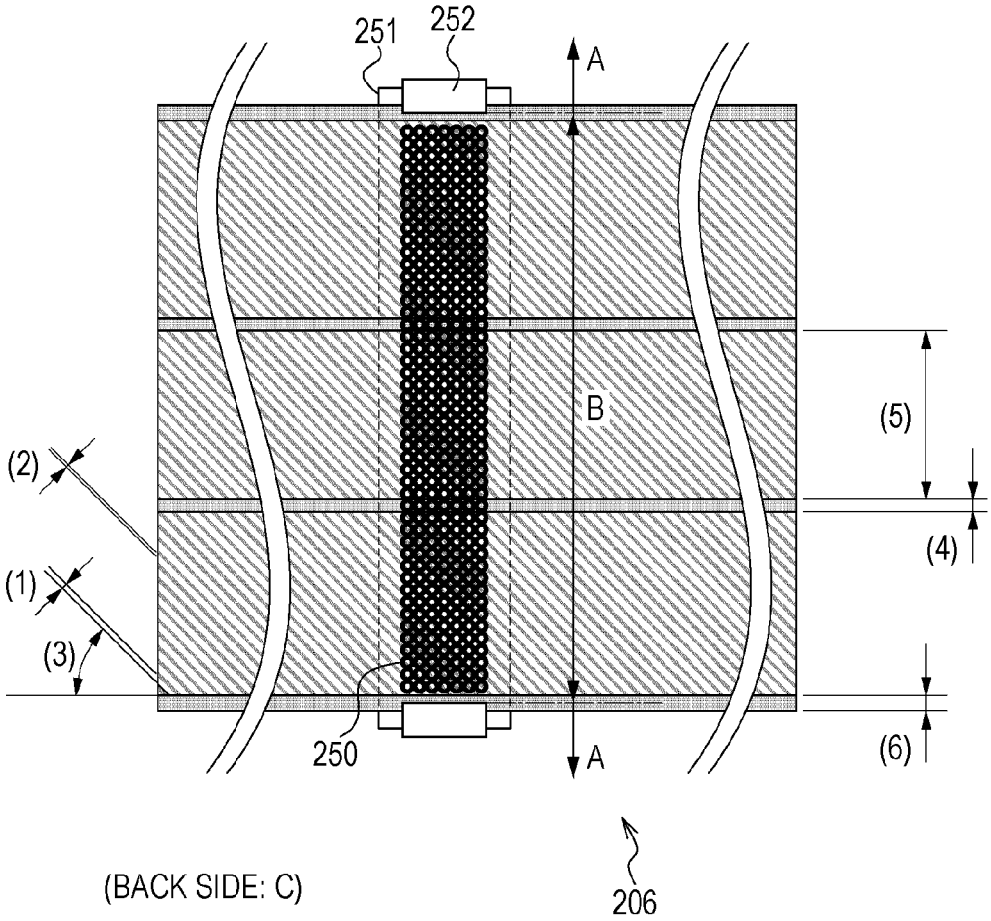
FIG. 7 is a top view of the grid viewed from a photosensitive member according to the present embodiment.

In the present embodiment, the grid 206 that serves as a control electrode is a so-called etching grid produced by subjecting a thin metal plate (thin plate) to an etching process. The thin plate is a plate-shaped member having a thickness of 1 mm or less. As illustrated in FIG. 7, the etching grid includes beam portions that extend in a longitudinal direction at both ends of the grid in a lateral direction, and has through holes that obliquely extend between the beam portions. Table 1 shows dimensions of the grid.

TABLE 1

| | |
|---|---|
| (1) | 0.312 ± 0.03 (mm) |
| (2) | 0.071 ± 0.03 (mm) |
| (3) | 45 ± 1 (°) |
| (4) | 0.1 ± 0.03 (mm) |
| (5) | 6.9 ± 0.1 (mm) |
| (6) | 1.5 ± 0.1 (mm) |

FIG. 7 illustrates the external shape of the grid. FIG. 7 is an enlarged top view of a part of the grid viewed from the member to be charged (photosensitive member). The mesh pattern of the grid 206 will now be described.

A central portion of the grid in the lateral direction has a mesh pattern in which lines having a width of 0.071±0.03 mm represented by (2) are formed with intervals having an open width of 0.312±0.03 mm represented by (1) therebetween so as to extend in a direction at an angle of 45±1° represented by (3) with respect to a base line.

To suppress bending of the grid 206, beams having a width of 0.1±0.03 mm represented by (4) are arranged in the mesh section so as to extend in the longitudinal direction of the grid with intervals of 6.9±0.1 mm represented by (5) therebetween. By forming a pattern including through holes having a width of 1.0 mm or less as described above by an etching process, the charge potential of the photosensitive member 1 can be made more uniform. The higher the ratio of the area of the mesh section to that of the through-hole section, the easier the charge potential can be made uniform. The plate-shaped grid is disposed between the discharge wire 2*h* and the photosensitive drum 1. The effect of making the charge potential of the photosensitive drum 1 uniform increases as the distance between the photosensitive drum 1 and the grid 206 decreases. In the present embodiment, the minimum distance between the photosensitive drum 1 and the grid is 1.5±0.5 mm.

The plate-shaped grid 206 extends between tensioning portions 207 and 209 arranged on the front block 201 and the rear block 202, respectively. The grid 206 can be released from the supported state by operating a knob 208 of the tensioning portion 207 disposed on the front block 201. Thus, the grid 206 can be easily attached and detached (see FIGS. 3A and 3B). The grid 206 is a plate having a curved portion at a position near the tensioning portion 209, and is somewhat stretchable. Therefore, even when the grid is arranged so as to extend in the corona charger, the grid can be moved by a certain distance by applying an external force thereto. In the present embodiment, the base member of the grid is produced by forming many through holes in a thin sheet metal by etching, the sheet metal being made of an austenitic stainless steel (SUS304, hereinafter referred to as SUS) and having a thickness of about 0.03 mm. Although a grid having a mesh pattern illustrated in FIG. 7 may be used as the plate-shaped grid according to the present embodiment, the shape of the grid is not limited to this. For example, a plate-shaped grid having a honeycomb structure described in, for example, Japanese Patent Laid-Open No. 2005-338797 may instead be used. A coating applied to the etching grid to improve, for example, resistance to corrosion will be described in detail below.

Charging Shutter

Next, a charging shutter (hereinafter referred to as a shutter) and a structure for retracting and housing the shutter will be described with reference to FIGS. 3A and 3B. The corona charger 2 includes a sheet-shaped shutter 210 that covers an opening (having a width of about 360 mm) in the housing that faces the photosensitive member, which serves as a member to be charged, at least over the entire region (having a width of about 300 mm) of a portion of the photosensitive member on which the images are formed. The shutter 210 moves through a gap between the grid 206 and the photosensitive member 1 to open or close the opening in the housing. In the image forming apparatus according to the present embodiment, when the shutter is in an open state, the minimum distance between the grid 206 and the photosensitive member 1 is as small as about 1.0 mm. Therefore, the shutter 210 is made of soft, flexible sheet-shaped nonwoven fabric so that the photosensitive member is not damaged even when the shutter comes into contact therewith. The width of the shutter in the lateral direction is greater than that of the corona charger in the lateral direction. In the present embodiment, the shutter 210 includes rayon fiber and has a thickness of 100 μm.

The shutter 210 is wound into a roll and accommodated by a retracting mechanism 211 for retracting the shutter at an end portion of the corona charger 2 in the longitudinal direction. The retracting mechanism 211 includes a roller to which an end portion of the shutter is fixed and a torsion coil spring that urges the roller. The shutter 210 is urged by the coil spring in a retracting direction thereof (direction for opening the opening), and therefore a central portion of the shutter in the longitudinal direction does not easily become slack.

When a tension is applied to the shutter 210 in the longitudinal direction of the corona charger, a state in which discharge products do not easily leak to the outside through the gap between the shutter 210 and the corona charger 2 can be maintained.

The retracting mechanism 211 is retained by the front block 201 together with a retaining case 214 that retains the retracting mechanism 211. A guide roller 215 that guides the shutter 210 so as to prevent the shutter 210 from coming into contact with an edge of the grid 206, the tensioning portion 207, or the knob 208 of the tensioning portion 207 is disposed near a shutter extracting portion of the retaining case 214.

The other end of the shutter 210 in the longitudinal direction is fixed to a leaf spring 212. The leaf spring 212 retains the shutter and pulls the shutter in a closing direction. In addition, the leaf spring 212 holds the sheet-shaped shutter in an arch shape so as to make the sheet stronger. Specifically, the shutter is held by the leaf spring 212 such that a central portion thereof in the lateral direction is convex toward the discharge wire.

The leaf spring 212, which serves as both a pulling member and a restraining member and which retains the leading end portion of the shutter 210, is connected to a carriage 213 that serves as a moving member included in a moving mechanism. The leaf spring 212 is made of a metal material having a thickness of 0.10 mm. Although the leaf spring 212 is thin, it is strong enough to pull the shutter.

When the carriage 213 is moved backward (in a direction for closing the opening) by receiving a driving force from a screw 217, which is included in the moving mechanism disposed above the corona charger, the shutter 210 is extracted from the retracting mechanism 211. When the carriage 213 is moved forward (in a direction for opening the opening), the shutter 210 is retracted by the retracting mechanism 211 and housed in the retaining case 214.

Cleaning Brush

The cleaning brush 250, which serves as a cleaning member for cleaning the grid, will now be briefly described. The charging device according to the present embodiment includes a cleaning brush that cleans a surface of the grid that faces the discharge wire by moving in the longitudinal direction. The cleaning brush moves in the longitudinal direction of the grid by receiving a driving force from an opening-closing motor M2, which is a drive source included in the moving mechanism for opening and closing the shutter.

The cleaning brush 250 cleans the grid by moving while an amount by which the cleaning brush 250 intrudes into the plate-shaped grid is maintained at a certain value. A brush holder 251 that holds the cleaning brush is made of an ABS resin (see FIGS. 6A and 6B).

The cleaning brush 250 includes a hair body formed by subjecting an acrylic brush to a flameproofing process and weaving the acrylic brush into a base material. Specifically, the cleaning brush is formed by winding acrylic pile yarns having a thickness of 9 decitex into the base material at a density of 70,000 yarns per inch, and the length of the pile yarns is set so that an amount by which the cleaning brush intrudes into the plate-shaped grid in the cleaning process is in the range of 0.3 to 1.0 mm. The hair body of the cleaning brush may instead be made of, for example, Nylon (registered trademark), polyvinyl chloride (PVC), or polyphenylene sulfide (PPS) resin. Similarly, the cleaning member is not limited to a brush, and may instead be a pad (elastic body) made of felt, sponge, etc., or a sheet to which an abrasive, such as alumina or silicon carbide, is applied.

Moving Mechanism of Shutter and Cleaning Brush

Referring to FIGS. 3A and 3B, the cleaning pad, the cleaning brush, and the shutter according to the present embodiment move together in the longitudinal direction of the corona charger by receiving a driving force from the opening-closing motor M2, which serves as a drive source included in the moving mechanism. With this structure, the number of drive sources (motors) can be reduced. The moving direction is switched by switching the rotation direction of the opening-closing motor M2 between forward and reverse so as to achieve a reciprocating movement.

The cleaning brush according to the present embodiment cleans the grid from the discharge-wire side. Here, a structure is employed in which the grid is moved (pulled) toward the discharge wire by a pulling mechanism, which will be described below, while the grid is being cleaned.

The grid is at a position where it is not moved toward the discharge wire when the grid is not being cleaned (see FIG. 3A).

In the cleaning process, the cleaning brush intrudes into the grid and cleans the grid while the grid is shifted toward the discharge wire (see FIG. 3B).

3. Shutter Opening-Closing Control and Grid Cleaning Control

Figure 4A:
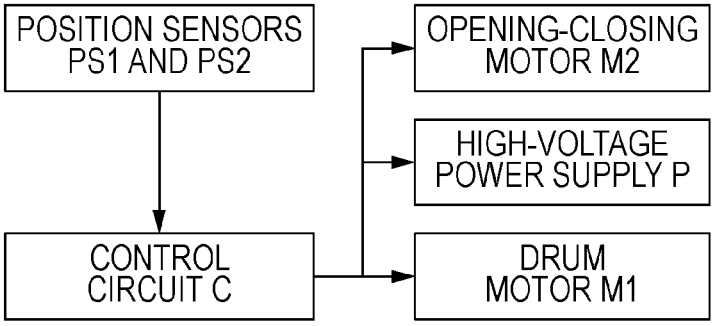
FIGS. 4A and 4B are diagrams for explaining a shutter opening-closing control operation in the corona charger according to the embodiment.
Figure 4B:
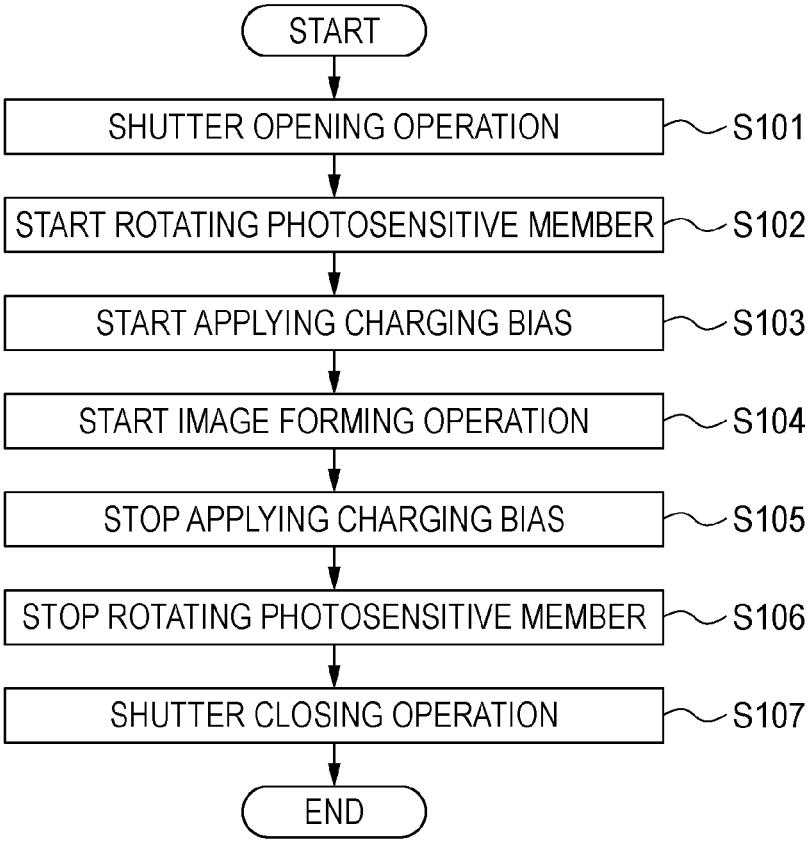
Figure 5A:
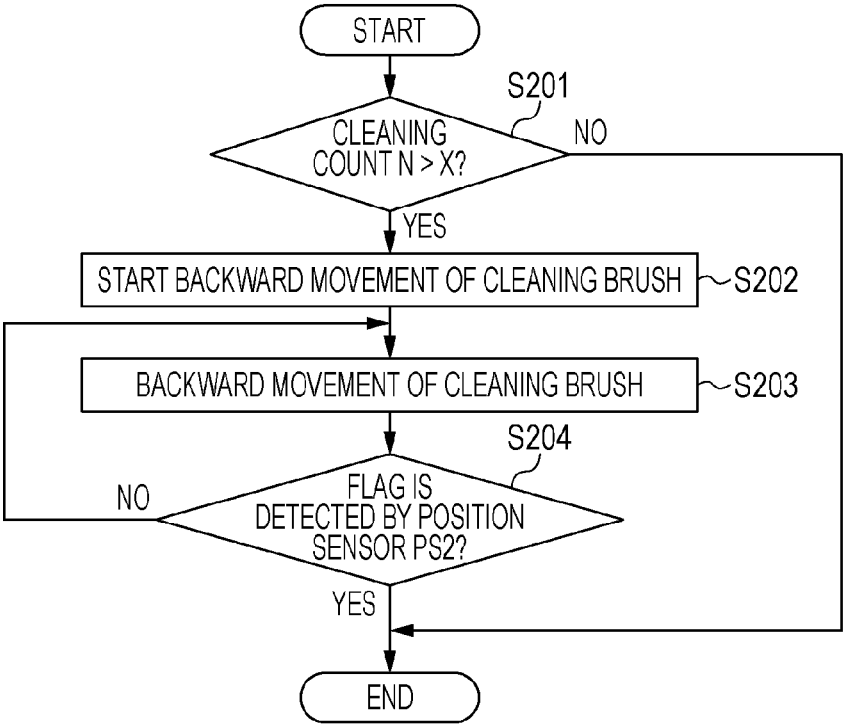
FIGS. 5A and 5B are flowcharts for explaining a grid cleaning control operation according to the embodiment.
Figure 5B:
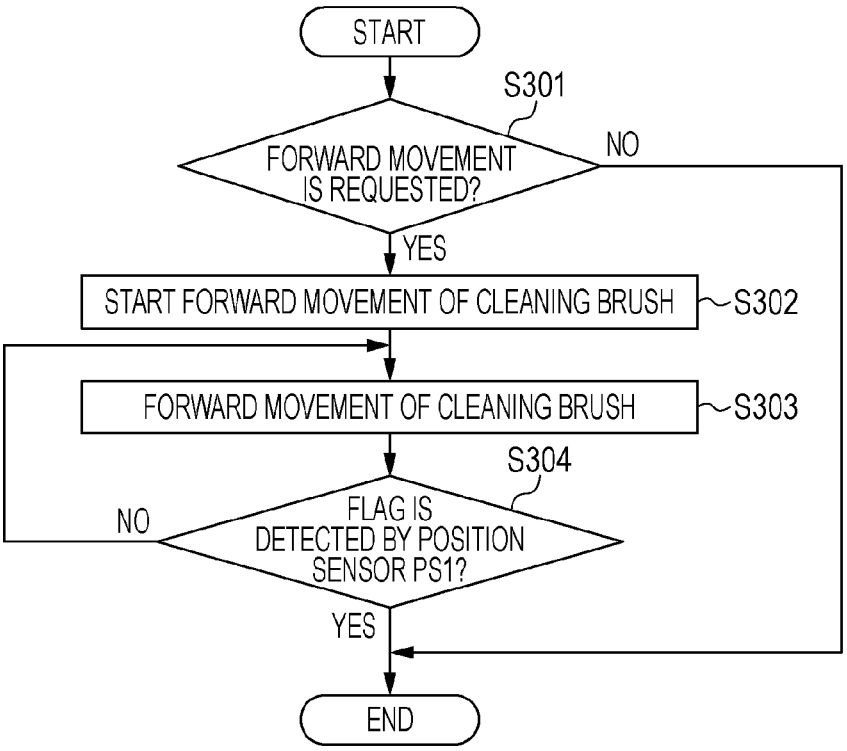

Next, shutter opening-closing control and grid cleaning control in the corona charger 2 will be briefly described. FIG. 4A is a schematic block diagram illustrating a control circuit, and FIG. 4B is a flowchart of a shutter opening-closing control operation. FIGS. 5A and 5B are flowcharts of a grid cleaning control operation.

Referring to FIG. 4A, the control circuit (controller) C, which serves as control means, controls the opening-closing motor M2, the high-voltage power supply P, and a drum motor M1, which serve as drive sources, in accordance with a program stored therein. As illustrated in FIGS. 3A and 3B, in the charging device according to the present embodiment, the cleaning brush 250 that cleans the grid and the shutter move by receiving a driving force from the same drive source (M2). Position sensors PS1 and PS2 transmit information regarding presence or absence of a flag to the control circuit C. In the case where the position sensors are provided, the control circuit C can recognize, for example, the position of the cleaning brush on the basis of the outputs from the position sensors. In other words, it can be determined that the cleaning brush has moved forward or backward from one end of the charger to the other end on the basis of the outputs from the position sensors. The control circuit C includes a memory which can be used as a counter that counts the number of sheets subjected to the image forming operation or a timer that measures the elapsed time.

Shutter Opening-Closing Control

When the control circuit C receives an image formation signal, if the outputs from the position sensors show that the shutter is in a closed state, the control circuit C moves the shutter so as to open the opening by driving the opening-closing motor M2 (S101). Subsequently, while the shutter in a retracted state (while the opening is opened), the drum motor M1 is driven so as to rotate the photosensitive member 1 (S102).

In addition, to charge the photosensitive member, the control circuit C causes the high-voltage power supply S to apply the charging bias to the discharge electrode and the grid (S103).

The photosensitive member 1 that has been charged by the corona charger 2 is subjected to processes performed by the laser scanner, the developing device, and other image forming units so that an image is formed on a sheet (S104). After the image forming operation, the control circuit C stops the application of the charging bias to the corona charger (S105), and then stops the rotation of the photosensitive member (S106).

After the rotation of the photosensitive member has been stopped, the control circuit C rotates the opening-closing motor M2 in the reverse direction to execute an operation of closing the opening with the shutter (S107). The operation of closing the shutter 210 may either be performed immediately after the image forming operation or after a predetermined time from when the image forming operation was finished.

In the present embodiment, the cleaning brush is moved in the longitudinal direction by the opening-closing motor M2 that moves the shutter. Therefore, the grid is cleaned in the shutter opening-closing operation. Accordingly, the occurrence of charging failure and non-uniform charging due to dust, toner, external additives, discharge products, etc., that adhere to the grid can be reduced and high-quality images can be formed over a long time.

Grid Cleaning Control

Next, the sequence of the grid cleaning operation performed by the cleaning brush of the charger will be described with reference to a flowchart. When the cleaning process is not performed, the cleaning brush is positioned at the front side of the image forming apparatus as viewed from the front. This position is defined as a reference position. In the following description, the movement of the cleaning brush from the front side toward the back side is referred to as a backward movement, and the movement from the back side toward the front side is referred to as a forward movement.

In FIGS. 3A and 3B, the right side corresponds to the front side of the image forming apparatus and the left side corresponds to the back side of the image forming apparatus.

The flowcharts of FIGS. 5A and 5B will now be described. When the image forming operation is repeatedly performed, discharge products, dust, toner and external additives that have been scattered, etc., adhere to the surface of the grid. When foreign matters adhere to the grid in a certain area, the charge potential changes in that area, which results in non-uniform image density. Therefore, the grid is cleaned with the cleaning brush to reduce the occurrence of image defects due to the adhesion of the foreign matters. The cleaning brush and the cleaning pad that cleans the discharge wire operate in association with each other, so that the grid electrode and the discharge wire are simultaneously cleaned in the cleaning operation described below.

The control circuit C counts the number of sheets that have been subjected to the image forming operation since the last time the cleaning operation was performed with the counter. The count is defined as a cleaning count N, and the cleaning count N is compared with a cleaning threshold Z (S201). In the present embodiment, Z is set to Z=1,000 for A4-size sheets. The control circuit C causes the cleaning brush to perform the backward movement each time the cleaning count N exceeds 1,000 (S202). The count N is not limited as long as it is proportional to the operation time of the charger, and the operation time of the charger may be counted as a determination criterion instead of the number of sheets subjected to the image forming operation. The opening-closing motor M2 is rotated in the forward direction to move the cleaning brush until the cleaning brush reaches the position (right end in FIG. 3A) at the side opposite to the side of the standby location (home position) (S203). The control circuit C stops the opening-closing motor M2 on the basis of the output from the position sensor PS2 disposed at a side opposite to the side of the standby location (S204). To simplify the structure, the position sensor may be omitted and the opening-closing motor M2 may be stopped by the control circuit C after a predetermined time (5 seconds).

Next, the forward movement of the cleaning brush will be described with reference to the flowchart of FIG. 5B. The control circuit C causes the cleaning brush to move forward in response to a request for the forward movement (S301). The backward movement and the forward movement may either be performed individually or continuously as a reciprocating movement.

When the forward movement is requested, the control circuit C rotates the opening-closing motor M2 in the reverse direction to move the cleaning brush (S302). The opening-closing motor M2 is rotated in the reverse direction until the cleaning brush reaches the home position (left end in FIGS. 3A and 3B) (S303). When the position sensor PS1 detects that the cleaning brush has reached the standby location, the control circuit C stops the opening-closing motor M2 (S304). Thus, dust, paper powder, toner, external additives, and discharge products that adhere to the grid are removed, so that the occurrence of non-uniform charging can be reduced and high-quality images can be formed over a long time.

In addition, since the cleaning member for cleaning the discharge wire is also moved at the same time, not only the grid but also the discharge wire is cleaned. Therefore, the occurrence of charging failure due to stains on the wire can also be reduced. In the structure of the present embodiment, the shutter moves so as to open or close the opening when the cleaning operation is performed since the same drive source is used as described above. Similarly, the grid is cleaned when the shutter opening-closing operation is performed.

4. Portions that Slide Along Pulling Mechanisms

Next, mechanisms for pulling the grid toward the discharge wire in the cleaning process will be described in detail. The cleaning brush according to the present embodiment cleans the grid from the discharge-wire side. Here, a structure for moving (pulling) the grid toward the discharge wire in the operation of cleaning the grid is employed.

Pulling Mechanisms

Figure 6A:
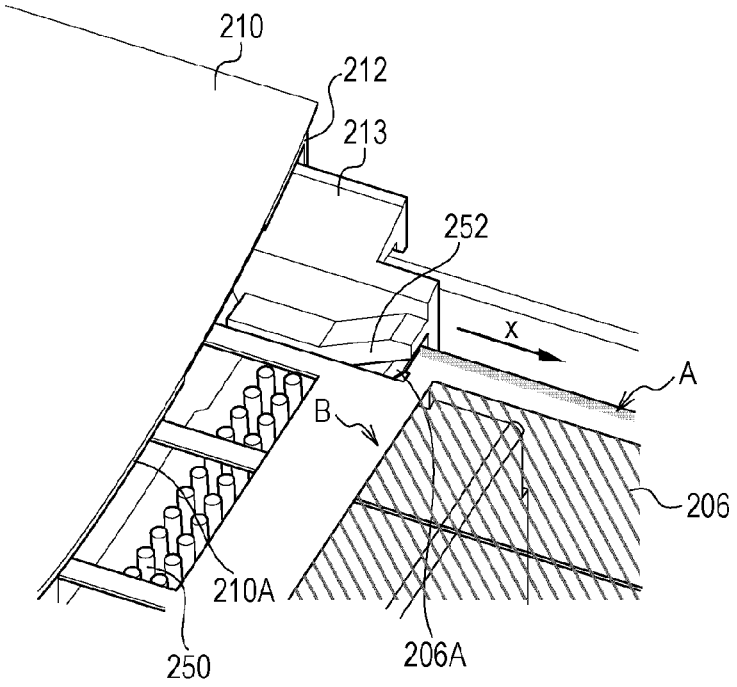
FIGS. 6A and 6B are enlarged views of a region around a pulling mechanism for a plate-shaped grid according to the present embodiment.
Figure 6B:
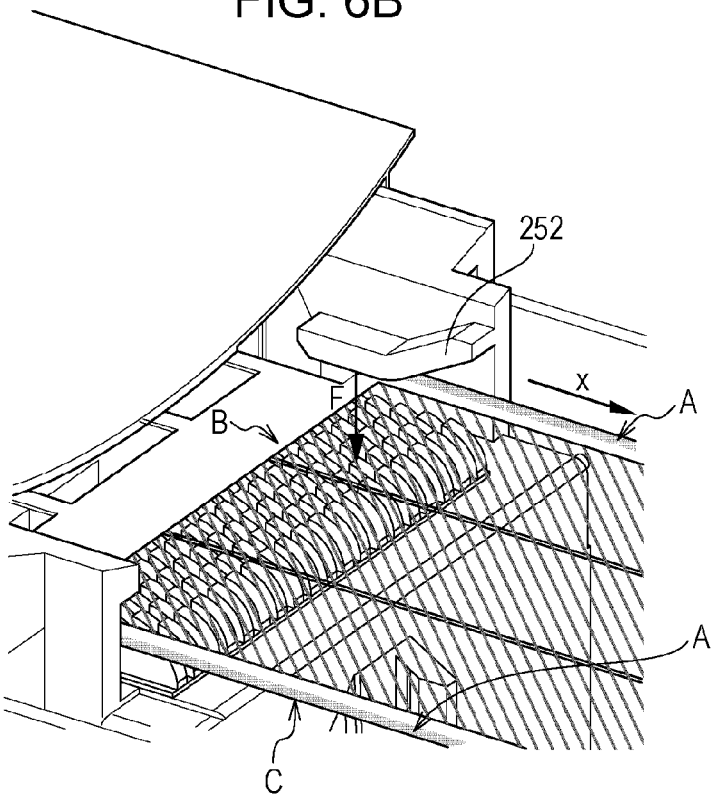

FIGS. 6A and 6B are enlarged views illustrating the mechanisms for pulling the grid toward the discharge wire. FIG. 6A illustrates the state in which the grid 206 is not in contact with a tapered portion of each pulling mechanism 252. FIG. 6B illustrates the state in which the tapered portion is in contact with the grid and presses the grid so that the grid is pulled (moved) toward the discharge wire.

The pulling mechanisms 252, which serve as pressing portions, are provided at both ends of the grid in the lateral direction. Each pulling mechanism 252 includes the tapered portion that pulls the grid toward the discharge wire and a sliding portion that slides along the grid. The pulling mechanisms 252 are formed integrally with the brush holder 251 that serves as a holder member for holding the cleaning brush. Accordingly, the grid is pressed by a force F in a direction from the member to be charged (photosensitive drum) to the discharge wire (see FIG. 6B) and is moved toward the discharge wire.

Pulling Operation

When the cleaning operation is not performed, the pulling mechanisms 252 (see FIGS. 6A and 6B), which serve as pressing members that pull the grid toward the discharge wire, are at positions where the pulling mechanisms 252 do not contact the grid (see FIG. 6A).

In the cleaning operation, the pulling mechanisms 252 on the brush holder 251 that holds the cleaning brush come into contact with the end portions of the grid in the lateral direction and press the grid so that the grid is pulled toward the discharge wire (see FIG. 6B). The cleaning brush intrudes into the grid and cleans the grid in the state in which the grid is moved toward the discharge wire.

Referring to FIG. 6A, when each pulling mechanism 252 is moved in the direction of arrow X in the figure at the corresponding end of the grid in the lateral direction, the tapered portion moves onto a surface of the grid that faces the photosensitive member. The grid is locally deformed by being pressed downward by the tapered portion, and receives a force F that moves the grid toward the discharge wire from the sliding portion of the pulling mechanism.

The brush holder 251 is made of a material, such as an ABS resin or PC, that has a rigidity higher than that of the hair body of the brush. The pulling mechanisms 252, which serve as pressing members and are made of the same material as that of the brush holder 251, press and move the grid in a direction from the member to be charged (photosensitive drum) to the discharge wire. The pulling mechanisms 252 are provided on both sides of the brush holder 251 that holds the cleaning brush 250 (see FIGS. 7 and 8).

Each pulling mechanism 252, which serves as a pressing member, has a rigidity higher than that of the hair body of the cleaning brush, and the force F is applied between the grid and the pulling mechanism 252. The hair body of the cleaning brush has a rigidity lower than that of the pulling mechanism 252, and can be bent so as to absorb a part of the force applied between the cleaning brush and the grid. Therefore, a force applied between the grid and each pulling mechanism 252 is smaller than F. The hair body of the cleaning brush is soft and has a coefficient of friction smaller than that of the pulling mechanism 252. As a result, a frictional force applied between each pulling mechanism 252 and the grid is greater than a frictional force applied between the cleaning brush and the grid.

Figure 8:
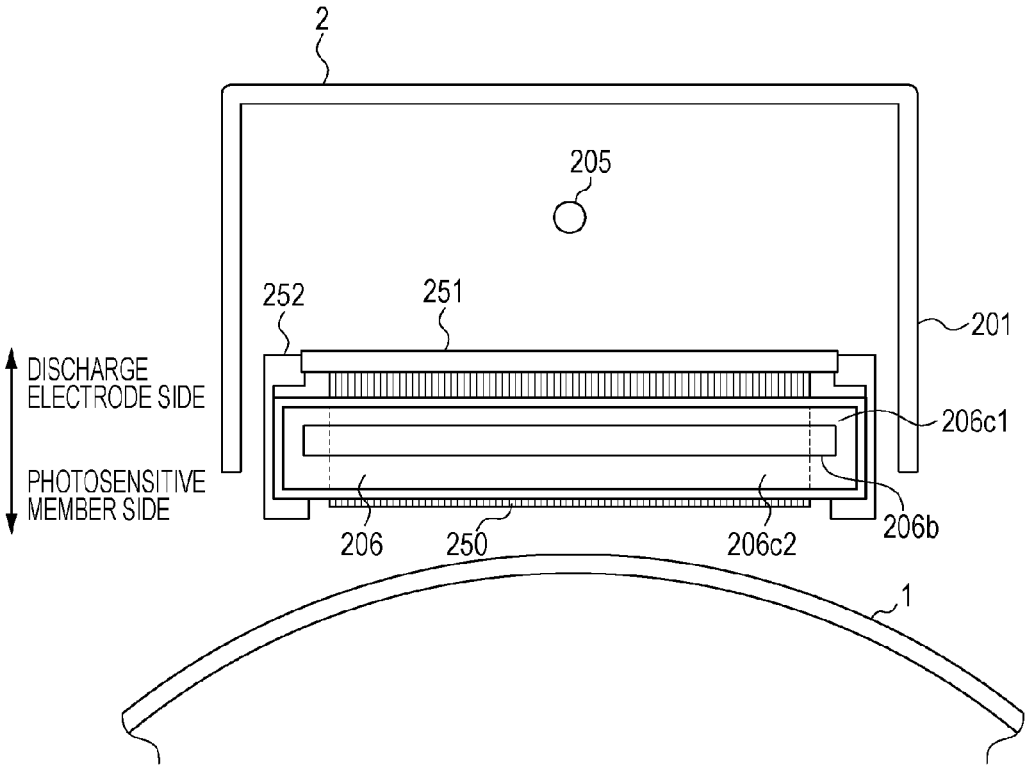
FIG. 8 is a schematic diagram illustrating a cross-sectional structure of the plate-shaped grid according to the present embodiment.

The pulling mechanisms 252 are provided on both sides of the brush holder 251 that holds the cleaning brush 250 (see FIGS. 7 and 8). Therefore, the grid locally wears as a result of reciprocation of the cleaning brush in the longitudinal direction of the corona charger. In the following description, the operation of pulling the grid toward the discharge wire (discharge electrode) will be described, and then regions in which the grid locally wears due to sliding contact will be described with reference to the drawings.

Sliding Portions

Referring to FIGS. 6A, 6B, and 7, portions of the grid that wear as a result of sliding contact with the sliding portions of the pulling mechanisms will be described. In the figures, portions of a photosensitive-member-side surface of the grid along which the sliding portions of the pulling mechanisms 252 slide are denoted by A, a portion of the photosensitive-member-side surface of the grid along which the sliding portions do not slide is denoted by B, and a discharge-wire-side surface of the grid is denoted by C. The portions A along which the sliding portions slide are at both ends of the grid in the lateral direction, and the portion B along which the sliding portions do not slide is a portion excluding the portions A.

FIG. 7 is a top view of the grid viewed from the photosensitive member. As illustrated in FIG. 7, the sliding portions of the pulling mechanisms 252 are arranged so as not to contact the mesh section of the grid. This is because the lines of the mesh pattern formed by etching the grid are thin and there is a possibility that the lines will break if the sliding portions slide along the lines. In FIG. 7, the back surface (discharge-wire-side surface) is the surface C.

5. Detailed Description of Coating of Grid

A surface treatment to which the plate-shaped grid 206 according to the present embodiment is subjected will now be described in detail. FIG. 8 is a diagram for explaining the base member and protective layers of the etching grid. Materials of the base member and the protective layers of the grid and a deposition method will now be described.

Base Member of Grid

As illustrated in FIG. 8, the upper side and the lower side of the etching grid 206 in the figure are referred to as a discharge-electrode side and a photosensitive-member side, respectively. In the present embodiment, the base member of the grid is made of SUS. A base layer 206*b* may be made of other types of stainless steels such as an austenitic stainless steel, a martensitic stainless steel, or a ferritic stainless steel.

As described above, the discharge products generated through corona discharge act as an oxidizer. Therefore, insulating metal oxide is generated by the discharge products even when the grid is made of a material, such as SUS, that has a relatively high resistance to corrosion. A passive film that mainly contains Cr oxide is formed on the surface of SUS. The passive film blocks the metallic substrate from the outside, and this imparts a relatively high resistance to corrosion to SUS. It is known that this passive film has a self-healing effect and therefore provides resistance to corrosion for a long time.

However, in the case where SUS is used as the material of the grid electrode of the corona charger, the material is exposed to an extremely severe environment (environment in which ozone and NOx densities are high). In particular, in a high-humidity environment, self-healing of the SUS cannot be achieved fast enough to avoid corrosion damage such as rusting. This is probably because metal atoms, such as Cr atoms, included in the passive layer that has been broken by the oxidizers (ozone, NOx, etc.) react with the oxidizers and rusting occurs before self-healing of the passive film is achieved. Specifically, a part of the ozone dissolved in moisture in the air decomposes so that free radicals (OH) are generated, and the SUS is probably oxidized as a result of indirect oxidation reaction of the ozone.

Material of Protective Layers

In the present embodiment, the base member 206*b* (SUS) of the grid is coated with tetrahedral amorphous carbon (hereinafter referred to as ta-C). Here, ta-C is a material that is categorized as a diamond-like carbon (hereinafter referred to as DLC) and that is highly chemically inactive with respect to discharge products.

In general, DLC has an amorphous structure which contains a certain amount of hydrogen and in which diamond bonds (or sp3 bonds) and graphite bonds (or sp2 bonds) are mixed.

Figure 9:
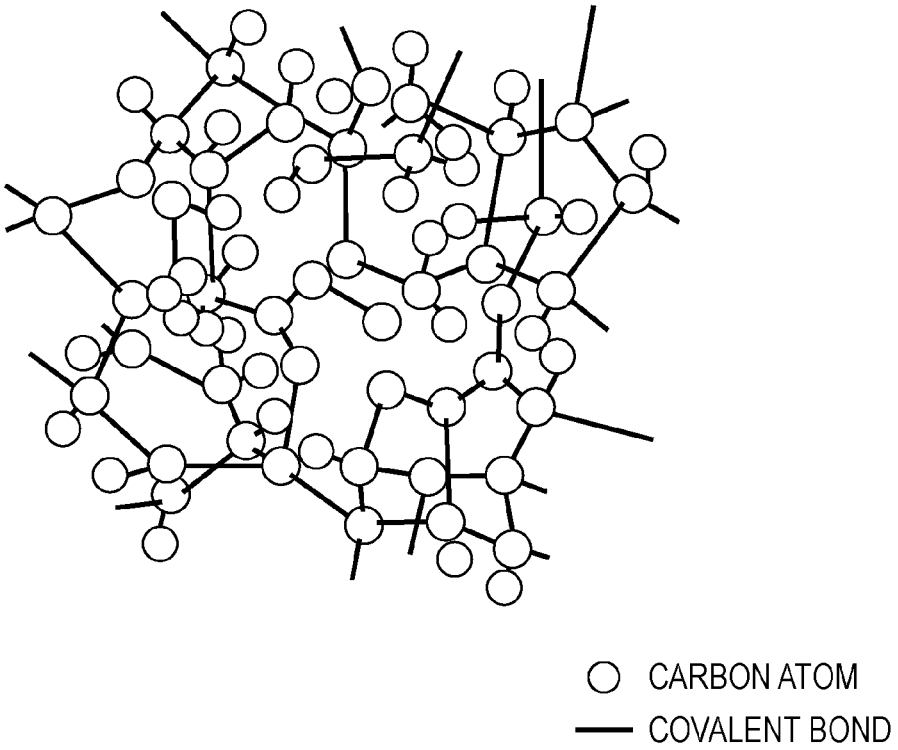
FIG. 9 is a diagram for explaining a ta-C structure according to the present embodiment.

FIG. 9 is a schematic diagram for explaining the structure of ta-C. White circles (○) represent carbon atoms and bars (–) represent bonds. On a microscopic scale, ta-C has a tetrahedral crystal structure. On a macroscopic scale, ta-C is a chemical species having an amorphous structure.

Figure 10A:
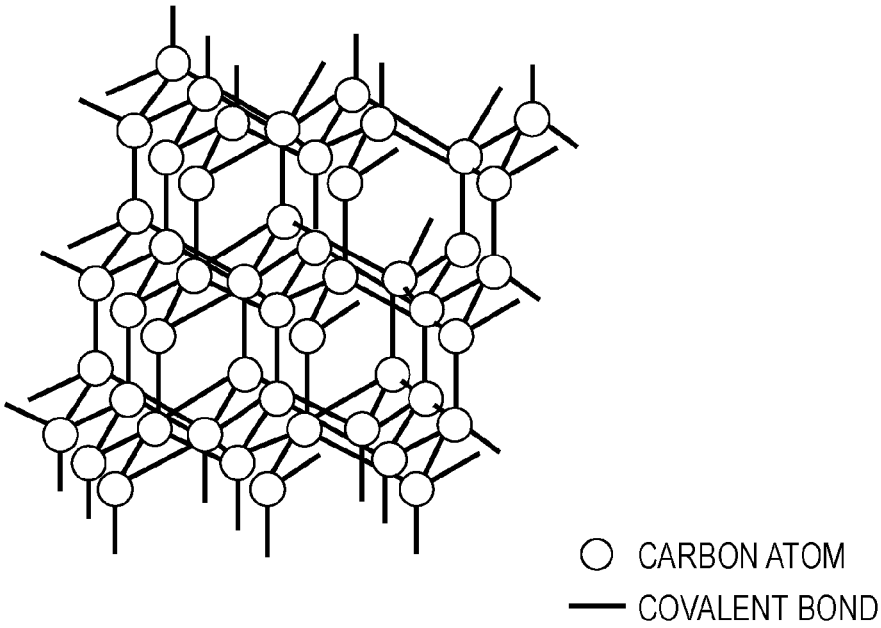
FIGS. 10A and 10B are diagrams for explaining a diamond structure and a graphite structure.
Figure 10B:
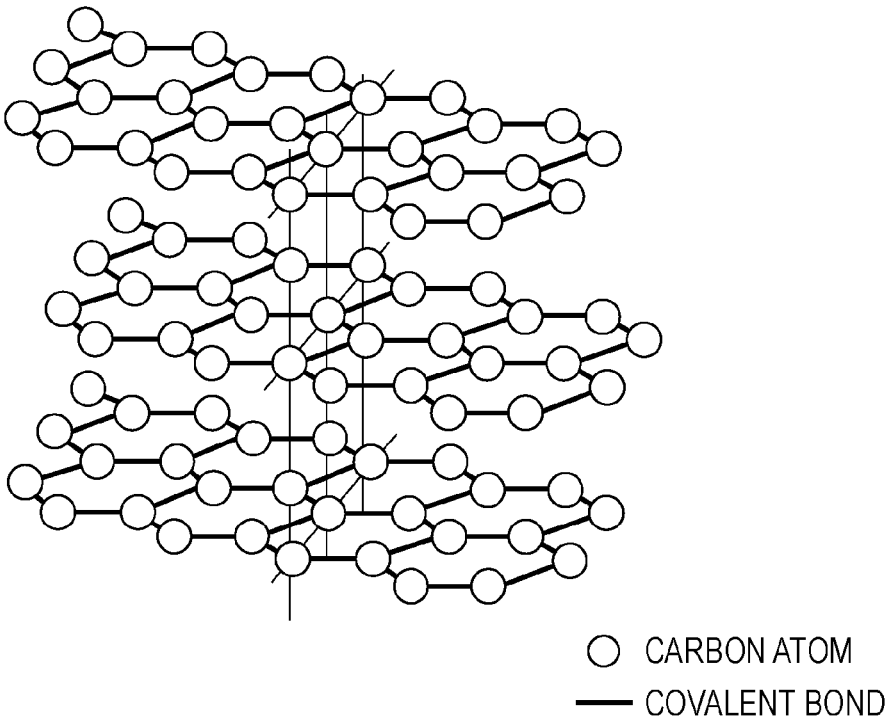

The structure of ta-C is such that sp3 bonds and sp2 bonds are mixed therein, and both the sp3 bonds (diamond structure) that affect hardness and sp2 bonds (graphite structure) that affect sliding properties are included in the composition. Accordingly, resistance to friction and wear properties vary in accordance with the ratio between the sp3 and sp2 bonds. When carbon atoms are crystallized only in sp3 hybrid orbitals, a diamond structure is formed as illustrated in FIG. 10A. Similarly, when carbon atoms are crystallized only in sp2 hybrid orbitals, a graphite structure is formed as illustrated in FIG. 10B.

Compared to other materials, ta-C, which has the above-described structure, has higher inactiveness with respect to air, water, etc., resistance to corrosion, resistance to wear, self-lubricating properties, hardness, and surface smoothness at room temperature. In addition, ta-C does not easily cause chemical absorption, oxidation reaction, etc., and is also resistant to partial functional degradation due to wear or defects.

The volume resistivity, layer thickness, and surface smoothness of the protective layers (ta-C layers) formed on the surfaces of the grid need to be optimized so that the corrosion effect is maximized without adversely affecting the charging performance. The material properties are preferably adjusted so that the volume resistivity is suitable for a charging member of an intermediate resistance. Accordingly, the volume resistivity of the protective layers (ta-C layers) may be in the range of about $1\times10^{7}$ to $1\times10^{10}$ Ω·cm. In the present embodiment, the protective layers (ta-C layers) are formed such that the volume resistivity thereof is in the range of about $1\times10^{8}$ to $1\times10^{9}$ Ω·cm, which is more preferable. In the present embodiment, deposition conditions under which the ta-C layers are formed are selected so that the ratio of the sp3 bonds to the sp2 bonds is 7:3.

Method for Forming Protective Layers

In the present embodiment, the ta-C layers are formed on the base member 206*b* (SUS) of the grid by using filtered cathodic vacuum arc (FCVA) technology. Although ta-C is a coating material that is superior to Cr in, for example, resistance to corrosion, coating methods for ta-C are limited. In general, a so-called vapor deposition (sputtering) method is used to coat a grid electrode with DLC.

Unlike "immersion plating" in which a base member is immersed in plating solution, it is difficult to form substantially identical protective layers on both sides of the grid by vapor deposition. This is because the protective layers are formed by retaining the grid in a low-pressure protective-film-forming chamber and blowing the material of the protective layers toward the grid in one direction. Therefore, it is difficult to form films having substantially the same thickness on both sides of the grid by a single vapor deposition process. Here, thicknesses are regarded as being substantially the same when the difference therebetween is about 10% of the layer thickness, that is, about ±5 μm in this example.

The process of forming the protective layers may be referred to as lining, facing, or coating, which are generically referred to as surface treatment in the present embodiment.

To form the ta-C layers on the SUS base member by the FCVA method, carbon plasma is generated from graphite by vacuum arc discharge, and ionized carbon is extracted from the carbon plasma and caused to accumulate on the SUS base member. Instead of the FCVA method, a physical vapor deposition (PVD) method or a chemical vapor deposition (CVD) method may be used.

Formation of Protective Films on Grid

The process of forming the protective layers by a vapor deposition method, such as the FCVA method, has directivity. Specifically, the growth rate of the protective film on a surface toward which protective material is blown differs from that on a surface at the other side. When the thin plate-shaped etching grid that has been subjected to an etching process is used, carbon (plasma) easily flows to the back side through the mesh section.

Therefore, even when the material is blown from one side of the grid, a protective film having a sufficient thickness can be formed also on the back side of the grid. Since the protective material is blown from one side, the thickness of the protective layer on the front surface toward which the material is blown is greater than that of the protective layer on the back surface. In the case where the material is supplied from both sides of the grid in the vapor deposition process, the cost is higher than that in the case where the material is supplied from one side. Therefore, the cost can be reduced by supplying carbon from one side of the grid and causing the carbon to flow to the back side through the mesh section so that layers are formed on both sides of the grid by vapor deposition. The thicknesses of the protective layers on the front and back surfaces do not differ by a large amount, and are relatively close to each other. Since the layer thicknesses are proportional to the deposition time, the time required to form the layers increases along with the target thicknesses of the layers. When the deposition time increases, the tact time of the deposition process, of course, decreases, which leads to an increase in cost. The cost can be reduced by stopping the deposition process when the thickness of the layer at the back side reaches the required layer thickness.

Accordingly, the layer thicknesses of the ta-C layers are preferably set so that no deposition defects occur at edge portions of the mesh section (end faces of the thin plate) formed by etching the plate-shaped grid. This is because when deposition defects occur at the edge portions, corrosion current concentrates at the edge portions in the image forming operation. There is a possibility that deposition defects will occur in the regions around the edge portions when the protective layers are formed such that the thicknesses thereof are less than 0.02 μm. Therefore, the thicknesses of the protective films formed on the grid are preferably greater than or equal to 0.02 μm.

Surface Properties of Protective Layer

Next, the surface properties of the grid after the formation of the protective layers (ta-C layers) will be described. When the surface roughness of the ta-C layers increases, the surface area of the ta-C layers formed on the surfaces of the grid also increases. When the surface area of the ta-C layers increases, the possibility that the discharge products, aerosols, and toner and external additives that have been scattered will adhere to the surfaces of the ta-C layers increases.

There is a risk that image defects will occur owing to adhesion of or corrosion caused by the discharge products, aerosols, and toner and external additives that have been scattered on the surfaces of the ta-C layers. Therefore, the surfaces of the ta-C layers are preferably smoothed.

The cleaning brush, which serves as a cleaning member for cleaning the grid, comes into contact with the grid according to the present embodiment. To reduce wear on the protective layers due to contact with the cleaning brush, the surfaces of the protective layers are preferably smooth. Various materials may be used as the material of the surface layers of the plate-shaped grid. However, the ta-C layers have a high resistance to wear as described above, and are therefore preferable as the material of the protective layers of the grid that cause contact friction against, for example, the cleaning member. The smoothness of the ta-C layers formed on SUS is easily affected by the surface roughness of SUS that serves as an underlayer.

The surfaces of the ta-C layers are preferably formed so that the arithmetical mean height Ra defined by JIS-B0601: 2001 is 2.0 μm or less. When the surfaces of the ta-C layers are such that Ra is 1.0 μm or less, adhesion of the external additives can be suppressed, even though the deposition cost increases in such a case. In the present embodiment, the ta-C layers are formed on the grid so that Ra of the surfaces thereof is in the range of 0.07 μm to 0.05 μm. In order for the ta-C layers to have the above-described smoothness, the SUS surfaces are formed such that the arithmetical mean height Ra defined by JIS-B0601:2001 is 1.5 μm or less. In the present embodiment, Ra of the SUS surfaces before the protective layers are formed thereon is in the range of 0.5 μm to 0.3 μm.

Deposition Conditions of ta-C Layer

Conditions under which the protective layers (ta-C layers) are formed on the etching grid will now be described. The deposition temperature at which the ta-C layers (protective layers) are formed is preferably 0° C. or more and 350° C. or less, and more preferably, 40° C. or more and 220° C. or less. The deposition rate is set to 1.5 nm/sec. The layer thickness at the discharge-wire side of the grid is 0.05 μm, and the layer thickness at the shutter side (photosensitive-drum side) of the grid is 0.06 μm, which is larger than the layer thickness at the wire side. When the color of the base material differs from the color of the protective layers, the difference in layer thickness can be detected by measuring the optical density. Specifically, SUS has a silver white color with a metallic luster, and the color of ta-C changes from reddish brown to bluish purple (ultramarine), and then to bluish silver in accordance with the layer thickness. Therefore, the deposition thickness can be detected on the basis of color or difference in density. In the case where the protective material is colorless and transparent or when the layer thickness is to be accurately measured, cross section of the grid may, of course, be observed with an electron microscope.

In the case where amorphous carbon (ta-C) is used as the protective material, carbon contained in the protective films has the sp3 structure and the sp2 structure at a predetermined ratio. As a result of studies conducted by the inventors, it has been found that resistances to corrosion and wear can be increased when the proportion of the sp3 structure is greater than that of the sp2 structure.

This is probably because when the proportion of the sp2 structure is large, micropore filling easily occurs between graphite planar layers so that other chemical species (ozone, discharge products, and free radicals in the present embodiment) are easily adsorbed. Although corrosion itself does not largely differ between the two types of structures, the composition ratio is probably affected by corrosion due to other factors (for example, contagious rusting). When the proportion of the sp3 structure is increased, a closely packed nanostructure is formed and the proportion of the crystal structure increases. This probably reduces the negative effects caused by the above-described other factors.

With regard to the composition ratio between the sp3 structure and the sp2 structure in the ta-C layers according to the present embodiment, it has been found through studies that the composition ratio of the sp3 structure to the sp2 structure in the ta-C layers is preferably sp3:sp2=6:4 or more. It has also been found through studies conducted by the inventors that, more preferably, the composition ratio is sp3:sp2=7:3 or more.

In the present embodiment, deposition conditions used in the process of forming the surface layers on the grid according to the present embodiment are selected so that the composition ratio of the sp3 structure to the sp2 structure is 7:3. The ratio between the sp3 structure and the sp2 structure of carbon in the protective layers can be detected by using a Raman microscope (for example, RAMAN-11 manufactured by Nanophoton Corporation) or the like. Specifically, Raman scattered light is generated by irradiating the ta-C layers with a laser beam, which is monochromatic light and serves as a light source, and is detected with a spectroscope or an interferometer to obtain a spectral distribution. The ratio between the sp3 and sp2 structures can be calculated on the basis of the peak of the obtained spectrum.

With regard to the deposition conditions for changing the composition ratio, a laser ablation method described in Japanese Patent Laid-Open No. 2005-15325 or a radio-frequency magnetron sputtering method described in Surface Science, Vol. 24, No. 7, pp. 411-416 may be used instead of the FCVA method. Accordingly, protective layers having various composition ratios can be formed by adjusting the substrate temperature, pulse voltage, assist gas flow rate, type of ambient gas, and anneal process temperature.

The deposition process is performed so that the ta-C layers are formed not only on the surfaces facing the discharge wire and the photosensitive member but also on the side surfaces of the grid that are orthogonal to the surfaces facing the discharge wire and the image bearing member. Accordingly, adhesion of the discharge products and aerosols and negative effects thereof can be reduced. In the present embodiment, the ta-C layers having a thickness of 0.02 μm or more are formed on the side surfaces of the grid that are orthogonal to the surfaces facing the discharge wire and the image bearing member.

In the present embodiment, the ta-C layers are formed so that the arithmetical mean height Ra, which is defined by JIS-B0601:2001, of the surfaces thereof is 2.0 μm or less. Since the ta-C layers are formed as the surface layers of the plate-shaped grid, not only the resistance to corrosion but also the resistances to wear and adhesion can be set to appropriate values. Accordingly, not only image defects due to corrosion of the grid but also those due wear and adhesion of foreign matters can be suppressed for a long time. Although the surface layers are preferably made of ta-C, other materials may instead be used.

Thicknesses of Protective Layers on Front and Back Sides of Grid

As described above, in the structure in which the grid is pulled toward the discharge wire, the portions A (see FIGS. 6A and 6B) of the grid along which the pulling mechanisms slide locally wears. Therefore, the grid according to the present embodiment is subjected to a process of forming the protective layers on the base member. In the present embodiment, to reduce costs, carbon is supplied from one side of the grid and caused to flow to the back side through the mesh section so that layers are formed on both sides of the grid. Therefore, as described above, the thickness of the protective layer on the front surface toward which the protective material is blown is greater than that of the protective layer on the back surface. Accordingly, vapor deposition is performed while the surface of the grid that faces the member to be charged is at the front side, so that the layer thickness at the member-to-be-charged side of the grid is greater than that at discharge-electrode side. Specifically, the deposition process is performed so that the deposition thickness at the photosensitive-drum side of the grid is 1.15 to 2.0 times that at the discharge-wire side. More preferably, the deposition thickness at the photosensitive-drum side is 1.2 to 1.8 times that at the discharge-wire side to make the levels of contamination and wear on the surfaces at the discharge-wire side and the photosensitive-drum side substantially equal to each other. Although non-uniform charging can be suppressed by increasing the deposition thickness on the grid, this is not preferable since the cost will increase due to, for example, an increase in time required to form the protective films on the grid. Accordingly, in the grid according to the present embodiment, the thickness of the protective layer at the discharge-wire side is set to 0.05 μm and that of the grid surface layer at the photosensitive-drum side is set to 0.07 μm.

6. Durability Evaluation of Grid

As described above, it has been found that when the grid is repeatedly cleaned while being pulled by the pulling mechanisms, portions of the ta-C layer that contact the pulling mechanisms wear and corrosion occurs from the worn portions. To determine the preferred thickness of the protective layer, the inventors have conducted a wear test of the ta-C layer and image and corrosion evaluation test by using grids having ta-C layers of different thicknesses.

Grids having ta-C layers with thicknesses in the range of 20 to 90 nm on the surfaces facing the charging wire and ta-C layers with thicknesses in the range of 20 to 120 nm on the surfaces facing the photosensitive drum were prepared for the evaluation test. To reduce the influence of components other than the pulling mechanisms and the cleaning brush, the test was performed while the shutter is removed.

Test Conditions and Evaluation Criterions

With regard to the test conditions, a total current of 1,000 μA was applied to the charging wire of the corona charger, and a voltage of −800 V was applied to each grid. Corona discharge was performed for 500 hours in total by applying the above-mentioned high voltage in a high-temperature, high-humidity environment (30° C., 80%). Specifically, the corona discharge was performed for 500 hours in total by repeating a process of turning off the high voltage applied to the charger every 0.25 hours, performing the reciprocating movement of the grid cleaning operation, and turning on the high voltage again.

Figure 11:
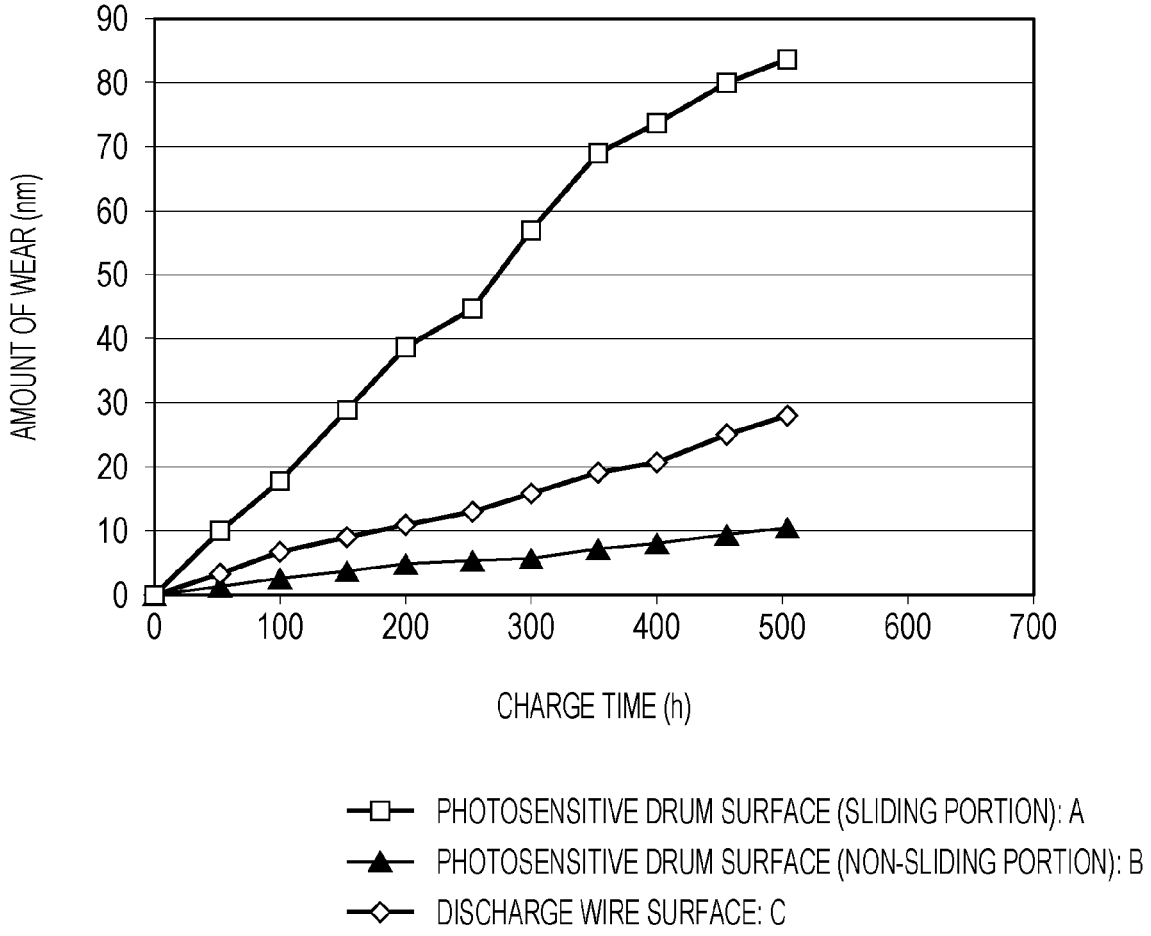
FIG. 11 is a graph for explaining the amount of wear on surface layers of the grid.

The result of the evaluation test performed by using the image forming apparatus structured as described above will now be described. FIG. 11 is a graph showing the result of measurement of the amounts of wear on the protective layers at the photosensitive-drum side and the discharge-wire side of the grid.

Wear Test

FIG. 11 is a graph showing the amounts of wear on the protective layers (ta-C layers) formed as the grid surface layers. The amounts of wear on the ta-C layers of the grid were measured by using an optical microscope or a surface roughness meter every time the corona discharge was performed for 50 hours. The amounts of wear on the grid surface layers were measured at a plurality of points in each of the regions A, B, and C illustrated in FIGS. 6A and 6B. In each region, the minimum thickness among the measurement results was determined as the amount of wear on the grid surface layer in that region.

FIG. 11 shows the result of measurement performed by using a grid having a ta-C layer with a thickness of 50 nm at the discharge-wire side and a ta-C layer with a thickness of 100 nm at the photosensitive-drum side. The amounts of wear on the surfaces of the grid at the photosensitive-drum side and the discharge-wire side were measured by the above-described test method.

As is clear from the result shown in FIG. 11, after 500 hours of corona discharge, the amount of wear on the ta-C layer at the discharge-wire side was about 30 nm, and the amount of wear on the ta-C layer at the photosensitive-drum side was about 85 nm. At the photosensitive-drum side, the amount of wear on the surface layer in regions where the surface layer contacts the pulling mechanisms 252 at both ends of the brush holder was greater than that at a position closest to the discharge wire (B).

A contact pressure at which the cleaning brush contacts the grid and a pressure at which the pulling mechanisms 252 on the brush holder 251 contact the grid were measured by using a pressure sensor. As a result, it was found that the contact pressure applied by the pulling mechanisms 252 of the brush holder 251 is about 7 to 30 times higher than the contact pressure applied by the cleaning brush. As is clear from the result illustrated in FIG. 11, the amount of wear at the photosensitive-drum side is larger than that at the discharge-wire side. The reason why the correlation between the contact pressure and the amount of wear on the surface at the discharge-wire side (C) and the surface on the photosensitive-drum side is small is probably because since the cleaning operation is performed immediately after the corona discharge, there is an influence of changes in the surface properties caused by the discharge in addition to that caused by mechanical sliding of the cleaning member.

Image Test

The image evaluation test was performed by using a color copier imagePRESSC1 manufactured by CANON KABUSHIKI KAISHA in which a grid having ta-C layers formed thereon is attached to a corona charger having a grid cleaning brush. Halftone images and the like were formed by using the charger used in the above-described corona discharge test, and the images and the grid were evaluated.

The images were evaluated by comparing density nonuniformity caused by irregularity with that on the initial image, and the degree of corrosion of the grid was also evaluated. With regard to the degree of corrosion of the grid, one of the surfaces of the grid with a higher degree of corrosion was evaluated.

It has been found from the test result that satisfactory corrosion and image evaluation results can be obtained when a ta-C layer having a thickness of 40 nm or more is formed at the discharge-wire side and that having a thickness of 60 nm or more is formed at the photosensitive-drum side. The test result also showed that, more preferably, satisfactory durability can be achieved when the layer thickness is 50 nm or more at the discharge-wire side and 70 nm or more at the photosensitive-drum side.

The result of the amounts of wear on the grid surface layers shown in FIG. 11 does not coincide with the evaluation result of the image and corrosion tests. This means that the amounts of wear on the grid surface layers do not directly lead to image degradation.

However, when the amounts of wear on the grid surface layers reach a certain value, corrosion and adhesion of foreign matters start to occur, and corrosion and nonuniform charging are caused accordingly. This leads to reductions in evaluation levels of corrosion and image quality. Therefore, it is necessary to determine the thicknesses of the ta-C layers in consideration of the amounts of wear on the grid surface layers and the levels of corrosion and image quality in the charging device. Preferably, the contact pressures applied between the grid and the cleaning brush and between the grid and the pulling mechanisms are also taken into consideration.

In light of the test results, in the present embodiment, the ta-C layers are formed on the grid so that the thickness of the protective layer at the discharge-wire side of the grid is 0.05 μm and the thickness of the protective layer at the photosensitive-drum side of the grid is 0.07 μm, as described above. Accordingly, nonuniform charging of the grid can be suppressed for a long time.

Preferably, when the grid is replaced, the degrees of wear and corrosion on the surface at the discharge-wire side and those on the surface at the photosensitive-drum side increase synchronously until a substandard (NG) image is formed. To replace the grid while the contamination level of one of the surfaces of the grid is still sufficiently low means that the corresponding surface layer on the grid is unnecessarily thick. When the deposition thickness is large, the possibility that the deposited layer will become separated from the base layer or bonding will occur increases. In addition, the deposition time and the amount of material are unnecessarily large, and the cost of the grid increases accordingly.

It is difficult to form ta-C layers having a thickness of 170 nm or more, and a large amount of deposition material and long deposition time are required. Therefore, the deposition thickness is preferably 170 nm or less. A durability test was performed by applying a total current of 1,000 μA to the discharge wire for 500 hours. As a result, it has been found that the deposition thickness of the ta-C layer at the discharge-wire side is preferably 20 nm or more and 170 nm or less and that at the photosensitive-drum side is 30 nm or more and 170 nm or less to maintain the level of corrosion at a moderate level after 500 hours of discharge.

An appropriate ratio between the thickness of the surface layer of the grid at the discharge-wire side and that at the photosensitive-drum side was studied. As a result, at least when the deposition thickness at the photosensitive-drum side is 1.15 times the deposition thickness at the discharge-wire side or more, corrosion due to wear does not become NG earlier at the photosensitive-drum side than at the discharge-wire side owing to sliding of the cleaning brush and adhesion of foreign matters.

The result of the evaluation test somewhat varies in accordance with the dimensional tolerance in the manufacturing process, operating conditions and environment of the apparatus, variation in the current applied to the discharge wire, and variation in the contact pressure applied by the cleaning brush. Considering these factors, the deposition thickness at the photosensitive-drum side of the grid is preferably in the range of 1.15 to 2.0 times the deposition thickness at the discharge-wire side. More preferably, the deposition thickness at the photosensitive-drum side is in the range of 1.2 to 1.8 times that at the discharge-wire side. In such a case, the contamination level of the surface at the discharge-wire side and that at the photosensitive-drum side increase substantially synchronously. Thus, the layers deposited on the grid can be prevented from being unnecessarily thick. Accordingly, the production time and the cost of the grid can be reduced. Similar effects can be obtained even when the surface layers are not made of ta-C. As described above, nonuniform charging can be suppressed for a long time by setting the thicknesses of the surface layers of the grid of the corona charger such that the thickness at the photosensitive-drum side is larger than that at the discharge-wire side.

Influence of Discharge Products that Adhere to Shutter

The above-described tests were performed while the shutter was removed to reduce the influence of other components. The occurrence of image deletion can be reduced by covering the opening in the corona charger with the shutter. However, the shutter is configured to pass through a small gap (2 mm or less) between the grid and the photosensitive member. Therefore, there is a possibility that the shutter will contact the grid due to vibration caused when the opening is covered with the shutter. As a result, the discharge products adhere to the shutter, which changes the corrosiveness of the grid. Accordingly, an additional test was performed in which the grid was left for 12 hours in the state in which the shutter was closed each time the grid cleaning operation was performed.

The sheet-shaped shutter according to the present embodiment is held in an arch shape so that the strength thereof is increased. Therefore, the shutter mainly contacts the portion (B) of the photosensitive-member-side surface of the grid that does not contact the pulling mechanisms. Namely, the portions (A) that wear as a result of allowing the pulling mechanisms for pulling the grid toward the discharge wire to slide therealong differ from the portion (B) that may come into contact with the grid due to vibration of the shutter. Thus, it is not necessary to make the thickness of the protective layer at the photosensitive-member side of the grid greater than that at the discharge-wire side by an extremely large amount, and non-uniform charging can be suppressed for a long time when the thickness of the protective layer at the discharge-wire side is 0.05 μm and that of the grid surface layer at the photosensitive-drum side is 0.07 μm.

Second Embodiment

In the present embodiment, a structure will be described which includes a fan and a heater for reducing the influence of discharge products generated in a corona charger during a discharge process in an image forming operation. Components having substantially the same structure as those in the first embodiment are denoted by the same reference numerals and explanations thereof are thus omitted.

An image forming apparatus according to the present embodiment includes a heater (not shown) that serves as heating means for heating a photosensitive member and a fan (not shown) that serves as blower means for causing air to flow into the corona charger 2. The heater and the fan are controlled by a control circuit C that serves as control means. The control circuit C maintains the temperature of the photosensitive member at a target temperature (38° C.), and thereby suppresses moisture absorption by the discharge products that adhere to the surface of the photosensitive member. Thus, image deletion can be suppressed.

In addition, the discharge products generated in a region around the discharge wire in the discharge process are discharged to the outside of the apparatus by the fan. Specifically, the fan generates airflow from above the discharge wire toward the photosensitive member through the grid. Owing to the airflow, adhesion of scattered toner to the grid and the amount of discharge products that adhere to the discharge-wire side surface of the grid can be reduced.

Adhesion of discharge products to the shutter can also be reduced by rotating the fan from when the image forming operation is finished to when the shutter is closed. The amount of discharge products, such as NOx, that adhere to the grid 206 and the shutter 210 can be reduced. Therefore, in the present embodiment, a control operation is performed in which the delivery fan is operated not only during the image forming operation but also for a predetermined period after the image forming operation is finished to reduce the amount of discharge products that remain in the charger.

After the image forming operation is finished, the possibility that the shutter will contact the grid can be reduced by rotating the fan at a speed lower than that in the image forming operation while the shutter 210 is being moved so as to cover the opening in the corona charger. However, if the shutter contacts the photosensitive member, there is a possibility that the photosensitive member will be contaminated. Therefore, in the present embodiment, the fan is stopped when the opening in the corona charger is covered with the shutter.

In the case where the fan is controlled so as to blow air in the image forming operation and stop when the opening is covered with the shutter as described above, the discharge products less easily accumulate on the discharge-wire side surface of the grid than in the first embodiment.

When a fan and a heater were additionally provided as in the present embodiment, the occurrence of image deletion and image defects due to contamination was suppressed for a long time. In the case where a fan is provided, even when the current that flows through the discharge wire varies, the influence of the discharge products that adhere to the wire-side surface of the grid can be reduced.

In the structure in which the grid is cleaned while being pressed against the cleaning member, non-uniform charging, which is caused by wear of the grid due to the grid being pressed against the cleaning member, is suppressed for a long time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A charging device that charges a member to be charged, the charging device comprising: a discharge electrode;

a housing that surrounds the discharge electrode and has an opening that faces the member to be charged;

a plate-shaped grid provided at the opening;

a cleaning member that cleans the grid by contacting a surface of the grid that faces the discharge electrode;

a pulling mechanism that sandwiches the grid between the mechanism and the cleaning member; and a moving mechanism that moves the cleaning member and the pulling mechanism in a longitudinal direction of the grid in a state sandwiching the grid between the cleaning member and the pulling mechanism, wherein the grid includes a base member, a first protective layer provided on a surface of the base member that faces the cleaning member, the first protective layer protecting the base member, and a second protective layer provided on a surface of the base member that faces the pulling mechanism, the second protective layer protecting the base member and being thicker than the first protective layer.

2. The charging device according to claim 1, wherein a frictional force applied between the pulling mechanism and the grid is greater than a frictional force applied between the cleaning member and the grid.

3. The charging device according to claim 1, wherein the pulling mechanism is disposed at a position where the pulling mechanism contacts an end portion of the grid in a lateral direction.

4. The charging device according to claim 3, further comprising:

a holder member that holds the cleaning member, wherein the pulling mechanism is provided to the holder.

5. The charging device according to claim 1, wherein the first protective layer and the second protective layer contain diamond-like carbon, and wherein a proportion of an sp3structure is higher than a proportion of an sp2structure in the carbon contained in the first protective layer and the second protective layer.

6. The charging device according to claim 1, wherein the first protective layer has a thickness of 20nm or more and 170nm or less, and wherein the second protective layer has a thickness of 30nm or more and 170nm or less.

7. The charging device according to claim 1, wherein a thickness of the second protective layer is in the range of 1.15to 2.00times a thickness of the first protective layer.

8. The charging device according to claim 1, wherein the first protective layer and the second protective layer have a volume resistance in the range of $1\times10^{7}$to $1\times10^{9}\Omega\cdot$cm.

9. The charging device according to claim 1, wherein the cleaning member is a brush.

10. The charging device according to claim 1, wherein the first protective layer and the second protective layer are formed by vapor deposition.

* * * * *